US012790803B2

(12) United States Patent
Pan et al.

(10) Patent No.: US 12,790,803 B2
(45) Date of Patent: Nov. 10, 2026

(54) DETACHABLE SHOWER PEDESTAL

(71) Applicant: JUNSKY APPLIANCES LIMITED, Zhongshan (CN)

(72) Inventors: Weiliang Pan, Zhongshan (CN); Zhigang Jiang, Zhongshan (CN); Yun Luo, Zhongshan (CN); Junfa Gan, Zhongshan (CN); Zixuan Lu, Zhongshan (CN)

(73) Assignee: JUNSKY APPLIANCES LIMITED, Zhongshan (CN)

( * ) Notice: Subject to any disclaimer, the term of this patent is extended or adjusted under 35 U.S.C. 154(b) by 76 days.

(21) Appl. No.: 18/926,696

(22) Filed: Oct. 25, 2024

(65) Prior Publication Data

US 2025/0171992 A1 May 29, 2025

(30) Foreign Application Priority Data

Nov. 29, 2023 (CN) ..... 202323237658.8

(51) Int. Cl.
*E03C 1/06* (2006.01)

(52) U.S. Cl.
CPC ..... *E03C 1/06* (2013.01)

(58) Field of Classification Search
CPC ..... E03C 1/06
USPC ..... 4/596
See application file for complete search history.

(56) References Cited

U.S. PATENT DOCUMENTS 4,413,362 A * 11/1983 Chianco ..... E03C 1/06 4/615
6,438,767 B1 * 8/2002 Warshawsky ..... E03C 1/066 4/596
10,060,103 B1 * 8/2018 Smith ..... E03C 1/06
2008/0083844 A1 * 4/2008 Leber ..... E03C 1/06 239/600
2021/0246640 A1 * 8/2021 Hu ..... B05B 1/18
2022/0305513 A1 * 9/2022 Lin ..... F16L 37/0847

FOREIGN PATENT DOCUMENTS

CN 216304813 U * 4/2022

OTHER PUBLICATIONS

Machine Translation of CN-216304813-U.*

* cited by examiner

*Primary Examiner* — Jeremy Carroll
(74) *Attorney, Agent, or Firm* — Birchwood IP

(57) ABSTRACT

The present invention relates to the field of sanitary ware, in particular to a detachable shower pedestal, which comprises a locking nut, an outer sleeve and an inner sleeve; one side of the outer sleeve is provided with a U-shaped notch, one side of the inner sleeve that is adjacent to the outer sleeve is also provided with a U-shaped notch, and the outer sleeve and the inner sleeve are connected in a sleeving mode; and a stud portion of the locking nut passes through the outer sleeve and is then in screw joint with the inner sleeve, and a screw head portion of the locking nut is provided on an outer side of the outer sleeve. The shower pedestal is suitable for outdoor water heaters, and is not prone to falling after mounting.

4 Claims, 3 Drawing Sheets

DETACHABLE SHOWER PEDESTAL

CROSS-REFERENCE TO RELATED APPLICATIONS

This application claims priority to Chinese Patent Application No. 202323237658.8, filed on Nov. 29, 2023, which is hereby incorporated by reference in its entirety.

TECHNICAL FIELD

The present invention relates to the field of sanitary ware, in particular to a detachable shower pedestal.

BACKGROUND

Existing outdoor water heaters are usually sold together with matching showers. During selling, the showers are mounted on shower pedestals, and the shower pedestals are connected to the outdoor water heaters or are not connected to other products. When users use the outdoor water heaters, the shower pedestals can be mounted on the water heaters, and the shower pedestals can also be separately mounted on recreational vehicles provided with the water heaters. For example, the shower pedestals are mounted on water pipes of the recreational vehicles or mounted on outer walls of the recreational vehicles, and meanwhile, the water pipes are connected to the outdoor water heaters.

However, mounting the shower pedestals on the water heaters is a method having a widest application range. Because after the water heaters are mounted on the outer walls of the recreational vehicles, the water pipes are not necessarily exposed on the outer walls of the recreational vehicles but are hidden in the recreational vehicles, and it is inconvenient to directly mount the shower pedestals on the outer walls of the recreational vehicles.

For example, a Chinese patent with a publication number CN216304813U discloses a shower pedestal, having a principle that "a pipe fitting can be easily inserted into an insertion channel. Then, an operating portion is released, an elastic member drives the operating portion to reset under the action of an elastic restoring force, at this time, a holding portion extends into the insertion channel to tightly hold the pipe fitting, and the shower pedestal is mounted on the pipe fitting". The prior art has the problems that although such shower pedestal is convenient to mount, it can only be mounted on the pipe fitting with a diameter within a certain range and usually cannot be adapted to the outdoor water heaters, and moreover, such shower pedestal has a complicated structure.

SUMMARY

In order to solve the above technical problems, a purpose of the present invention is to provide a detachable shower pedestal suitable for outdoor water heaters.

A technical solution adopted in the present invention to solve the problems is: a detachable shower pedestal, comprising:

a locking nut, an outer sleeve and an inner sleeve; one side of the outer sleeve is provided with a U-shaped notch, one side of the inner sleeve that is adjacent to the outer sleeve is also provided with a U-shaped notch, and the outer sleeve and the inner sleeve are connected in a sleeving mode; a stud portion of the locking nut passes through the outer sleeve and is then in screw joint with the inner sleeve, and a screw head portion of the locking nut is provided on an outer side of the outer sleeve; and one end of the inner sleeve that is away from the outer sleeve is provided with a shower slot.

As a further improvement of the above technical solution, the locking nut, the outer sleeve and the inner sleeve are all made of plastic.

As a further improvement of the above technical solution, a depth of a U-shaped groove on the outer sleeve is smaller than a depth of a U-shaped groove on the inner sleeve.

As a further improvement of the above technical solution, the inner sleeve comprises a main body and a clamping portion, the clamping portion is fixedly connected to the main body, and the shower slot is provided at an outer end of the clamping portion.

As a further improvement of the above technical solution, a screw head surface of the locking nut and a surface of the main body are both provided with anti-slip textures.

Beneficial effects of the present invention: Compared with the use of an elastic member to clamp an externally provided water pipe in the prior art, relative positions of the inner sleeve and the outer sleeve have a wider adjustable range, such that the shower pedestal of the present invention can be mounted on a series of pipe fittings with wider diameters, comprising rod-shaped handles of outdoor water heaters, etc. Moreover, the U-shaped notches on the inner sleeve and the outer sleeve are combined to form a complete circle, which are not prone to falling off after mounting.

BRIEF DESCRIPTION OF DRAWINGS

The present invention will be further explained below in conjunction with the description of the accompanying drawings and specific embodiments.

In the figures: 1—locking nut, 2—outer sleeve, 3—inner sleeve, 31—main body, 32 clamping portion, 4—U-shaped notch, 33—shower slot, 5—anti-slip texture.

DESCRIPTION OF EMBODIMENTS

This section will describe the specific embodiments of the present invention in detail. The preferred embodiments of the present invention are shown in the accompanying drawings. The function of the accompanying drawings is to supplement the statement of the text part of the description with graphics, so that people can intuitively and vividly understand each technical feature and overall technical solution of the present invention. However, the accompanying drawings shall not be construed as a limitation to the protection scope of the present invention.

In the statement of the present invention, it should be understood that orientation statements, such as orientation or position relationships indicated by up, down, front, back, left, right, etc., are based on the orientation or position relationships shown in the accompanying drawings and are only to facilitate the statement of the present invention and simplify the statement, rather than indicate or imply that the device or element referred to must have a specific orientation, be constructed and operate in a specific orientation, and therefore should not be understood as a limitation to the present invention.

In the statement of the present invention, "several" means one or more, "a plurality of" means two or more, "greater than", "less than", and "more than", etc. are understood to exclude the original number, and above, below, within, etc. are understood to include the original number. If there is a statement of first and second, it is only for the purpose of distinguishing technical features, and cannot be understood as indicating or implying the relative importance or implicitly indicating the number of indicated technical features or implicitly indicating the order of indicated technical features.

In the statement of the present invention, unless otherwise explicitly specified, words such as setting, mounting and connection should be understood in a broad sense. Those skilled in the art can reasonably determine the specific meanings of the above words in the present invention in combination with the specific content of the technical solution.

Figure 1:
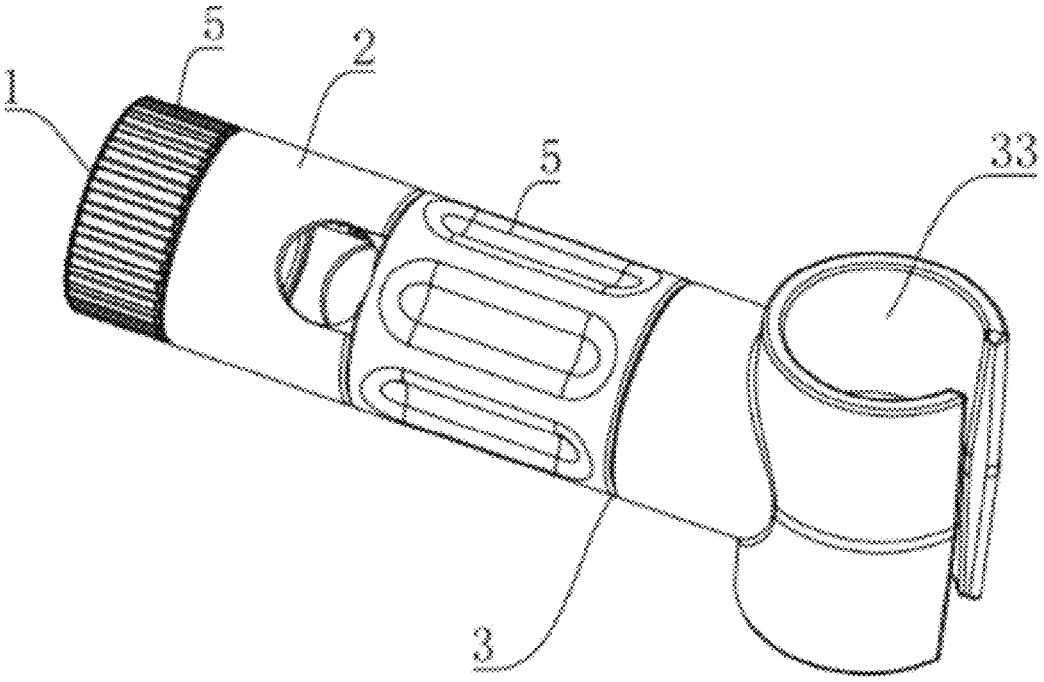
FIG. 1 is a perspective view of a detachable shower pedestal of the present invention.
Figure 2:
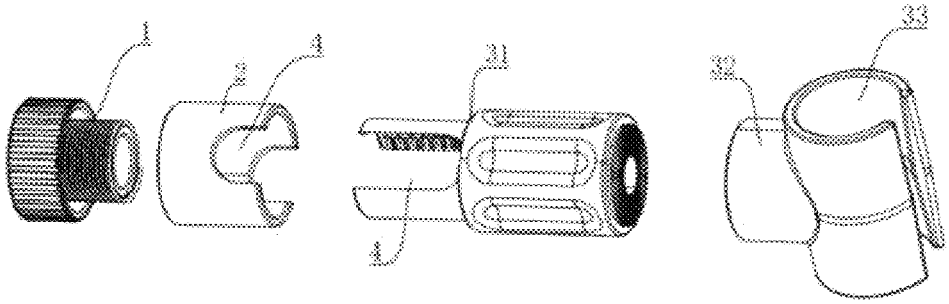
FIG. 2 is an exploded view of the detachable shower pedestal of the present invention in one direction.
Figure 3:
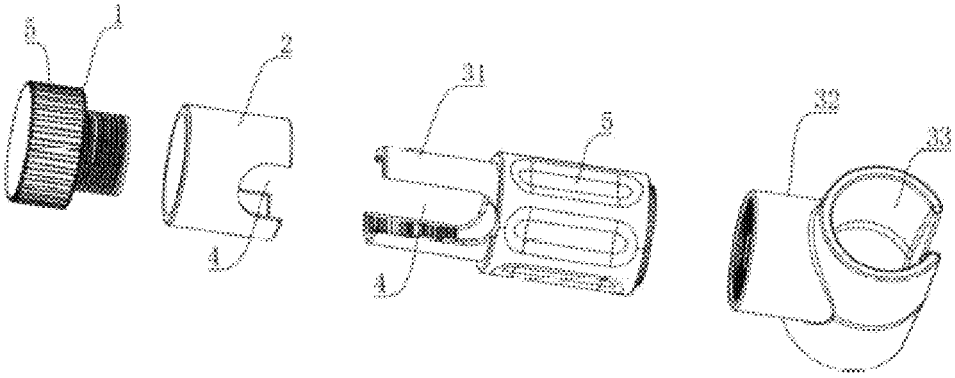
FIG. 3 is an exploded view of the detachable shower pedestal of the present invention in another direction.

Referring to FIG. 1 to FIG. 3, a detachable shower pedestal comprises:

a locking nut 1, an outer sleeve 2 and an inner sleeve 3; one side of the outer sleeve 2 is provided with a U-shaped notch 4, one side of the inner sleeve 3 that is adjacent to the outer sleeve 2 is also provided with a U-shaped notch 4, and the outer sleeve 2 and the inner sleeve 3 are connected in a sleeving mode; a stud portion of the locking nut 1 passes through the outer sleeve 2 and is then in screw joint with the inner sleeve, and a screw head portion of the locking nut 1 is provided on an outer side of the outer sleeve 2; and one end of the inner sleeve 3 that is away from the outer sleeve 2 is provided with a shower slot 33.

Use principle: The locking nut 1 and the inner sleeve 3 are relatively rotated to adjust relative positions of the inner sleeve 3 and the outer sleeve 2, and the U-shaped notches 4 on the inner sleeve 3 and the outer sleeve 2 are used to tightly clamp left and right sides of a handle of an outdoor water heater, respectively, or to tightly clamp a water pipe. Compared with the use of an elastic member to clamp an externally provided water pipe in the prior art, in the present embodiment, relative positions of the inner sleeve 3 and the outer sleeve 2 have a wider adjustable range, and the U-shaped notches 4 on the inner sleeve 3 and the outer sleeve 2 are combined to form a complete circle, such that the shower pedestal of the present invention can be mounted on a series of pipe fittings with wider diameters, comprising rod-shaped handles of outdoor water heaters, etc. Moreover, the shower pedestal is not prone to falling off after mounting.

As a preferred embodiment, the locking nut 1, the outer sleeve 2 and the inner sleeve 3 are all made of plastic. The plastic will not rust when exposed to water.

In a preferred embodiment, a depth of a U-shaped groove on the outer sleeve 2 is smaller than a depth of a U-shaped groove on the inner sleeve 3, such that convenience is provided for connecting the inner sleeve 3 and the locking nut 1, and an adjustment range of the two is wider.

In some optional embodiments, the inner sleeve 3 comprises a main body 31 and a clamping portion 32, the clamping portion 32 is fixedly connected to the main body 31, and the shower slot 33 is provided at an outer end of the clamping portion 32. The inner sleeve 3 of such structure facilitates injection molding.

In some embodiments, a screw head surface of the locking nut 1 and a surface of the main body 31 are both provided with anti-slip textures 5.

The above are only preferred embodiments of the present invention, and are not intended to limit the patent scope of the present invention. Under the invention concept of the present invention, equivalent structural transformations made using the contents of the description and drawings of the present invention, or directly or indirectly used in other relevant technical fields are all included in the patent protection scope of the present invention.

What is claimed is:

1. A detachable shower pedestal, wherein the detachable shower pedestal comprises:

a locking screw, an outer sleeve, and an inner sleeve;

one side of the outer sleeve is provided with a U-shaped notch, one side of the inner sleeve that is adjacent to the outer sleeve is also provided with a U-shaped notch, and the outer sleeve and the inner sleeve are connected in a sleeving mode;

a stud portion of the locking screw passes through the outer sleeve and is then in screw joint with the inner sleeve, and a screw head portion of the locking screw is provided on an outer side of the outer sleeve; and one end of the inner sleeve that is away from the outer sleeve is provided with a shower slot, wherein a depth of a U-shaped groove on the outer sleeve is smaller than a depth of a U-shaped groove on the inner sleeve.

2. The detachable shower pedestal according to claim 1, wherein the locking screw, the outer sleeve and the inner sleeve are all made of plastic.

3. The detachable shower pedestal according to claim 1, wherein the inner sleeve comprises a main body and a clamping portion, the clamping portion is fixedly connected to the main body, and the shower slot is provided at an outer end of the clamping portion.

4. The detachable shower pedestal according to claim 3, wherein a screw head surface of the locking screw and a surface of the main body are both provided with anti-slip textures.

* * * * *